United States Patent [19]

Blechschmid et al.

[11] Patent Number: 4,556,785

[45] Date of Patent: Dec. 3, 1985

[54] APPARATUS FOR VAPOR SHEATHED BAKING OF SEMICONDUCTOR WAFERS

[75] Inventors: John Blechschmid, Chagrin Falls, Ohio; Richard D. Coyne, San Jose, Calif.; David Palmer, Andover, Mass.; John A. Piatt, Sunnyvale, Calif.

[73] Assignee: GCA Corporation, Bedford, Mass.

[21] Appl. No.: 496,818

[22] Filed: May 23, 1983

[51] Int. Cl.[4] ..... H05B 3/68

[52] U.S. Cl. ..... 219/460; 219/388; 219/400; 219/462; 219/530; 126/21 A; 432/121

[58] Field of Search ..... 219/369, 371, 388, 400, 219/460, 462, 530, 531, 540; 432/11, 120, 121, 122, 124, 235; 126/21 A, 400

[56] References Cited

U.S. PATENT DOCUMENTS 4,273,981 6/1981 Nopper ..... 219/388 X
4,321,031 3/1982 Woodgate ..... 432/11
4,436,985 3/1984 Weber ..... 219/388
4,518,848 5/1985 Weber ..... 219/388

OTHER PUBLICATIONS

Boomhower et al., *IBM Technical Disclosure Bulletin,* "Heated Base Airtrack Tool System for Heated Media or Reactive Wafer Transport/Processing", pp. 2944–2948, vol. 19, No. 8, Jan. 1977.

*Primary Examiner*—Volodymyr Y. Mayewsky
*Attorney, Agent, or Firm*—Henry D. Pahl, Jr.

[57] ABSTRACT

In the heat treating apparatus disclosed herein, semiconductor wafers are baked on the circular hot plate while being sheathed with a uniform vapor flow. The preferred vapor is a mixture of a relatively large volume of nitrogen carrying a relatively small volume of HMDS. After passing over the wafer, the vapor sheath is drawn, through an annular gap, into an exhaust chamber which surrounds and underlies the hot plate thereby avoiding heat and vapor loss into the other portions of the semiconductor fabrication line within which the baking apparatus is typically incorporated.

8 Claims, 5 Drawing Figures

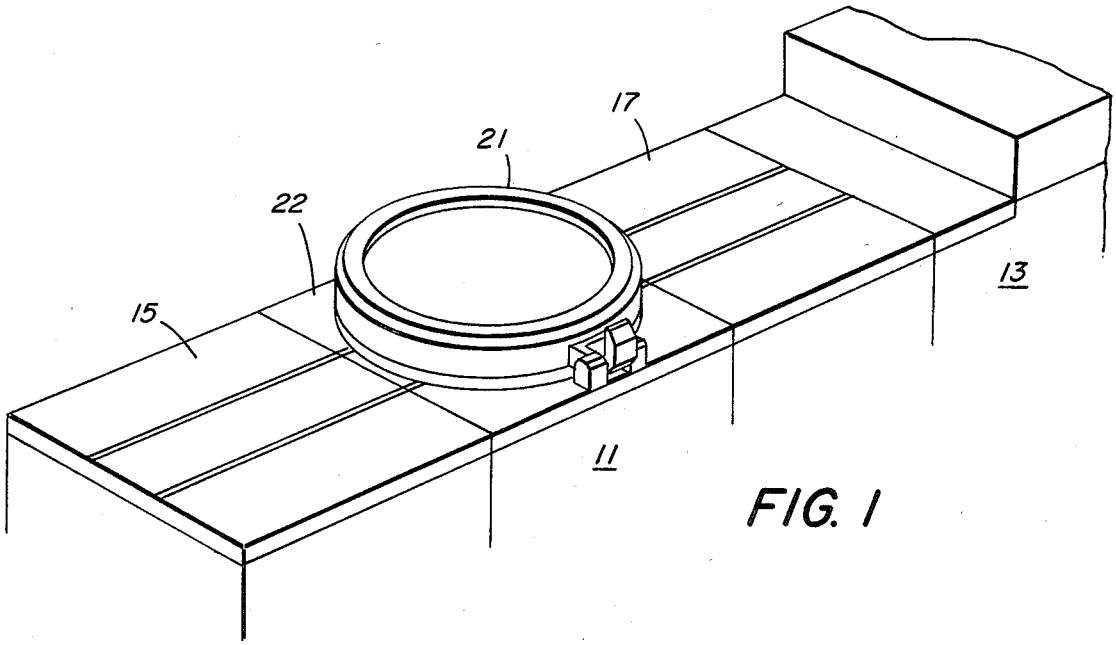
FIG. 1
FIG. 3
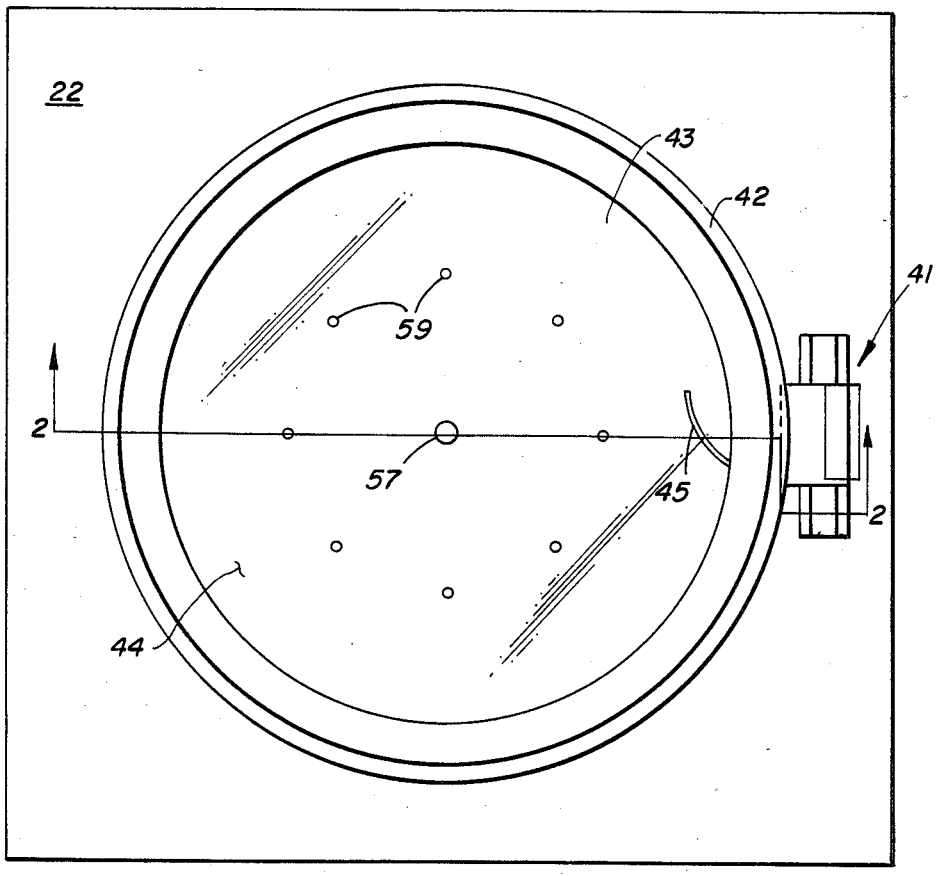

APPARATUS FOR VAPOR SHEATHED BAKING OF SEMICONDUCTOR WAFERS

BACKGROUND OF THE INVENTION

The present invention relates to the baking of semiconductor wafers and more particularly to apparatus for performing such a baking in a vapor sheath which both treats the wafer and removes heat from the environment.

While most baking treatments of semiconductor wafers are typically performed in batch furnaces or in large ovens through which the wafers are transported on belts, it has also been proposed to bake semi-conductor wafers by means of small local heaters which may be incorporated, on an in-line basis, in a continuous semiconductor fabrication line. For example, two different forms of hot plate constructions, for different purposes, are disclosed in copending, coassigned U.S. patent application Ser. Nos. 263,928 and 373,978. In each of these constructions, however, the process is, to some extent, open to the environment and, accordingly there is some unavoidable heat loss. As is understood by those skilled in the art, semiconductor fabrication is inherently a precision process and it is typically desired to carefully control all parameters affecting each of the various process steps. It is therefore highly undesireable to have a disruptive heat source located within the process area. It has also been found advantageous to perform certain reactive treatments of the wafers simultaneously with the baking and the prior art in-line systems do not facilitate such treatment.

Among the several objects of the present invention may be noted the provision of apparatus for performing in-line baking of semiconductor wafers; the provision of such apparatus which does not release unacceptable quantities of heat into the environment; the provision of such apparatus which sheathes the baking semiconductor wafer in the controlled vapor stream; the provision of such apparatus which performs reactive treatment of the wafers during baking by vapor supplied to the wafer surface; the provision of such apparatus which prevents release of reactive vapors into the environment; the provision of such apparatus which will treat wafers under precisely controllable and repeatable conditions; the provision of such apparatus which is not wasteful of reactive constituents; the provision of such apparatus which is highly reliable and is of relatively simple and inexpensive construction. Other objects and features will be in part apparent and in part pointed out hereinafter.

SUMMARY OF THE INVENTION

Briefly, apparatus according to the present invention is adapted for performing the vapor sheathed baking of semiconductor wafers. The wafers are baked on a circular hot plate of a conductive material providing substantially uniform temperature over the diameter of the wafer. Around and under the plate is an exhaust chamber providing a uniform annular gap between the periphery of the plate and the corresponding edge or rim of the chamber. Over the hot plate there is a cap which substantially covers the hot plate while allowing wafers to be brought to and taken from the hot plate. This cap includes means for providing a radially outward vapor flow over the surface of a wafer resting on the plate, the gas flow being then drawn into the exhaust chamber through the annular gap.

Preferably, the cap is mounted by means of a hinge structure located to one side of the hot plate and the hinge includes means for vaporizing a reactive fluid into a inert gas flow.

BRIEF DESCRIPTION OF THE DRAWINGS

FIG. 1 is a perspective view of a semiconductor fabrication line employing air track wafer transport and including in-line heat treating apparatus in accordance with the present invention;

FIG. 3 is a top view showing the vapor port arrangement in a cap structure employed in the heat treating apparatus;

Corresponding reference characters indicate corresponding parts throughout the several views of the drawings.

DESCRIPTION OF THE PREFERRED EMBODIMENT

Figure 2:
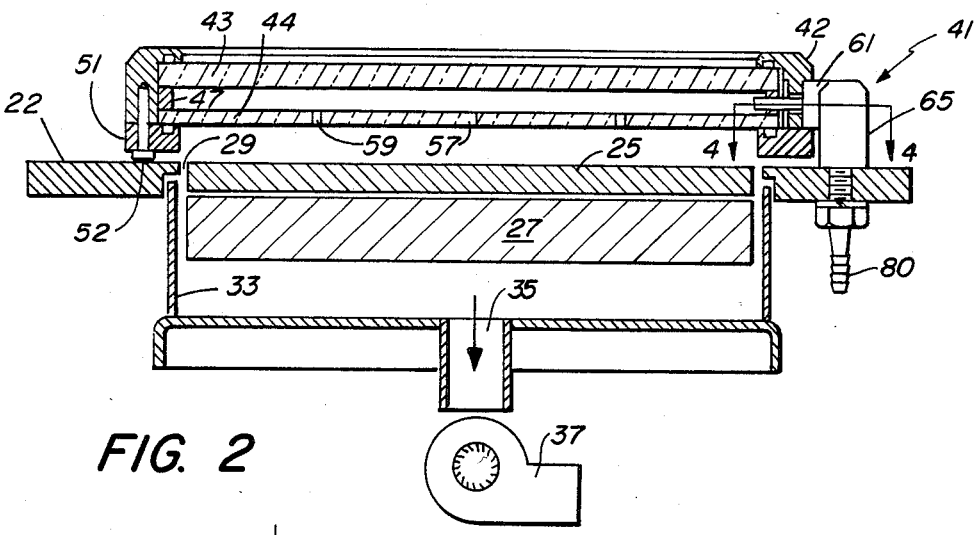
FIG. 2 is a transverse sectional view of the heat treating apparatus.

Referring now to FIG. 1, there is illustrated a portion of a continuous semiconductor fabrication line of the type which employs air bearing transport of semiconductor wafers from work station to work station. Such in-line fabrication systems are for example sold by the GCA Corporation of Bedford, Mass. under the Trademark "Wafertrack". Successive work stations are for example designated by reference characters 11 and 13 with lengths of air bearing track 15–17 being provided for transporting wafers from one work station to the next.

As illustrated, the work station 11 incorporates heating apparatus in accordance with the present invention, and, in particular, the incorporation of a wafer treating hot plate covered by a pivoted cap, designated generally by reference character 21. The baking station is incorporated in a section of the air track 22 which is otherwise similar to the sections 15–17. As is understood by those skilled in the art, such air tract sections are typically individually controllable so that semiconductor wafers may be brought to and taken from each work station on a time controlled sequence in accordance with the desired parameters of the particular fabrication process being implemented.

Referring now to FIG. 2, the hot plate itself comprises a circular disk 25 of a metal highly resistant to corrosion. As is understood, corrosion resistance is highly important to avoid the formation of oxidation products which would contaminate the semiconductor wafers themselves. A suitable material is hastelloy-x manufactured by the Cabot Company of Kokomo, Ind. A heater block 27 is bonded to the underside of the disk 25. Heater block 27 preferably includes temperature sensors as well as a resistance heater element so that controlled heating of the disk 25 may be provided to maintain any selected temperature.

As may be seen, the disk 25 is set into a corresponding circular opening in the air track section 22 with its surface essentially flush with the track so that wafers may be readily brought in to the heat-treating station by the appropriate operation of the air bearings. An annular gap 29 is provided around the hot plate for venting purposes as described in greater detail hereinafter. Surrounding and underneath the hot plate is an exhaust chamber 33 which connects, through a port 35, to a suitable exhaust blower, indicated diagramatically by reference character 37.

The cap 21 is pivotally mounted over the hot plate 25 on a hinge structure, designated generally by reference character 41. As may be seen in FIG. 2, the cap 21 comprises an annular metalic rim 42 which holds two circular glass plates 43 and 44 with the space between the plates 43 and 44 being maintained by a spacers 47. This layered structure is held together in the rim by a ring 51 secured by bolt 52. While the cap 21 overlies the hot plate in alignment therewith, its lower surface is spaced slightly above the hot plate and the level of the air track 22 so that wafers can be introduced and taken from the work station by the air track system. If desired, the hot plate disc 25 may itself include suitable air bearing ports for facilitating wafer transport, as in prior art devices.

As is explained in greater detail hereinafter, a vapor flow is introduced into the cap through the hinge structure 41. This flow entering the cap through a port 55 (FIG. 4) which opens into the space between plates 43 and 44. A baffle 45 (FIG. 3) starts the vapor on a circular flow in the plenum between the plates. Plate 44 is apertured as illustrated in FIGS. 2 and 3, there being a ¼ inch central aperture 57 with a plurality of smaller (⅛ inch) apertures 59 distributed around the central aperture at a distance approximately half way between the aperture 57 and the rim. As will be understood, these apertures or ports allow the vapor flow to pass over the surface of a semiconductor wafer resting on the hot plate 25 so that a uniform distribution and flow of the vapor is obtained over the wafer's surface.

After passing over the surface of the wafer, the vapor flow is drawn into the annular gap 29 surrounding the hot plate and into the exhaust chamber 33. In this way, the loss of heat from the hot plate into the environment around the work station 11 is very limited, since the wafer and the hot plate together with its heater are completely sheathed in a vapor flow which carries away the heat generated by the heater.

Figure 4:
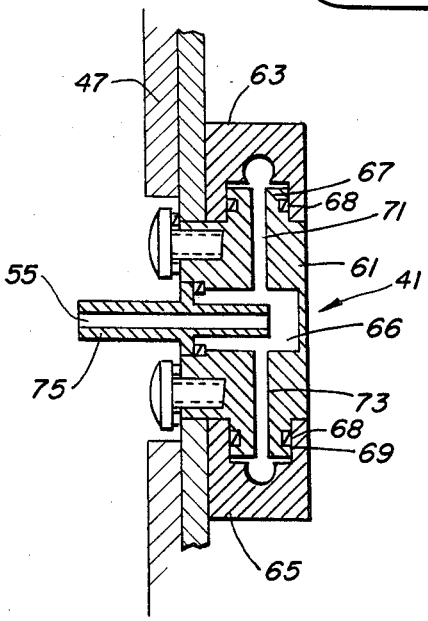
FIG. 4 is a face view, taken substantially on the line 4—4 of FIG. 2 showing a hinge block employed in the heat treating apparatus of FIG. 2, which hinge block incorporates a cyclone.
Figure 5:
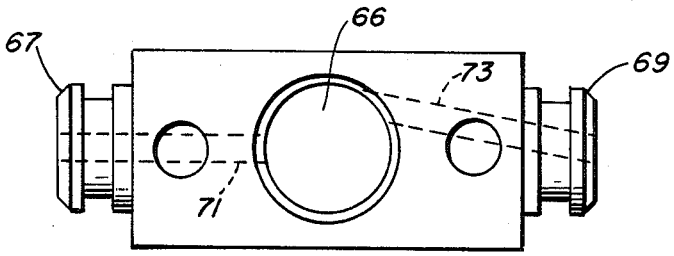
FIG. 5 is a top view, with parts broken away, of the hinge block/cyclone construction.

As may be seen in FIGS. 4 and 5, the hinge structure 41 comprises a central portion 61 which moves or pivots with the cap 21 together with a pair of stationary blocks or legs 63 and 65. In order to facilitate the reactive treatment of a wafer during baking, the hinge assembly 41 incorporates a cyclone structure for atomizing a reactive liquid constituent into an inert carrier gas.

A preferred reactive material is HMDS (hexamethyldisilazane) which, because of its volitility and flammability, is typically provided in a 50/50 mixture with a quenching material such as freon. Suitable such mixtures are available from the Baker Chemical Company of Hayward, Calif. While HMDS has previously been employed to treat silicon wafers, such treatment has typically been conducted in batch processes where a small amount of HMDS is introduced into a vessel, sometimes referred to as a "bomb", with a large number of wafers and the entire assembly is then heated or baked.

While bubbling may be used in some instances to mix a vaporizable liquid into a gas, this is not satisfactory in the case of HMDS/freon mixtures since the differing of those constituents will cause fractional distillation to occur, thereby resulting in a varying concentration of HMDS in the vapor stream. Atomization of the HMDS/freon mixture in the inert gas has been found to be greatly preferable since a metered quantity of HMDS may be introduced into the gas flow so that fixed proportions or concentrations of the reactive material can be assured.

As may be seen in FIG. 4, each of the mixture components can be introduced into the hinge assembly through a respective one of the stationary blocks 63, 65. The central portion 61 of the hinge assembly includes a cyclone chamber 66 and, on each side of the chamber 66, a respective hollow pivot portion 67 and 69 which extends into a respective stationary block 63, 65. O-rings (68) are used to provide a rotary seal. The liquid component (HMDS and Freon) is introduced through the block 63 and the port through the pivot 67, designated by reference character 71, is drilled so that it enters the chamber 66 on-axis as may be seen in FIG. 5. The inert purge gas, typically nitrogen, is introduced through the block 65 and the port through the corresponding pivot portion 69 is drilled, as indicated at 73, so that it enters the chambers 66 tangentially. The inert purge gas, and the liquid component are introduced into stationary blocks 65 and 63 respectively through nozzle 80, and an identical nozzle not shown, lying directly behind nozzle 80 on a line into the drawing of FIG. 2. As the volume of purge gas employed will typically be large in comparision with the volume of the reactive liquid composition, it will be understood that a vortex or cyclone will be generated in the chamber 66 and this cyclone action will tend to atomize and vaporize the liquid introduced through the port 71. The vapor mixture is extracted from the central portion of the cyclone chamber 66 through a nozzle structure 75. Due to the centrifugal action of the cyclone atomization, unvaporized droplets are held to the periphery of the chamber 66 and are not swept along with the exiting vapor. Thus reducing the chances of any entrained droplet which could spatter on the wafer degrade the treatment of the surface thereof.

Summarizing, it can be seen that the apparatus of the present invention facilitates the baking of semiconductor wafers within a vapor sheath. The vapor sheath carries heat away from the wafer and heater assembly so as to cause minimal thermal contamination of the semiconductor fabrication line within which the apparatus is typically incorporated. The vapor sheath can comprise a controlled mixture of a reactive liquid in an inert purge gas so that reactive treatment of the surface of the wafer can take place during the baking.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

We claim:

1. Heat treating apparatus for performing vapor sheathed baking of semiconductor wafers, said apparatus comprising:

a circular hot plate of a conductive material providing substantially uniform temperature over the diameter of said plate;

heater means for bringing said plate to a preselectable controlled temperature;

an exhaust chamber around and under said plate and heater, there being a uniform annular gap between the periphery of said plate and said chamber;

over said hot plate, a cap structure which substantially covers said hot plate while allowing wafers to be brought to and taken from said hot plate and which includes means for providing an outward vapor flow over the surface of a wafer resting on said plate, said gas flow being then drawn into said exhaust chamber through said annular gap.

2. Apparatus as set forth in claim 1 wherein said cap structure is pivotally mounted over said hot plate by means of a hinge on one side of said hot plate and wherein said vapor flow is introduced into said cap structure axially through the hinge pivot.

3. Apparatus as set forth in claim 12 wherein said hinge includes a central portion movable with said cap structure and, on each side of said central portion, a stationary block, each block being provided with a fluid inlet and means for coupling fluid flow into said central portion of said hinge.

4. Apparatus as set forth in claim 3 wherein the central portion of said hinge includes means for mixing the fluids introduced through the respective inlets.

5. Apparatus as set forth in claim 4 wherein one of said fluids is a liquid and the other is a gas and wherein said mixing means comprises a cyclone mixing said liquid into said gas without the inclusion of droplets in the fluid flow introduced into said cover.

6. Apparatus as set forth in claim 5 wherein said gas is nitrogen and wherein said liquid includes hexamethyldisilazane.

7. Heat treating apparatus for performing vapor sheathed baking of semiconductor wafers, said apparatus comprising:

a circular hot plate of a conductive material providing substantially uniform temperature over the diameter of said plate;

heater means for heating said plate;

an exhaust chamber around and under said plate and heater, there being an annular gap between the periphery of said plate and said chamber;

cyclone means for vaporizing a liquid comprising hexamethyldisilazane into a carrier gas;

over said hot plate, a cap structure which substantially covers said hot plate while allowing wafers to be brought to and taken from said hot plate and which includes means for providing a radially outward flow of said vapor over the surface of a wafer resting on said plate, said gas flow being then drawn into said exhaust chamber through said annular gap.

8. Apparatus as set forth in claim 7 wherein said gas is nitrogen.

* * * * *